US007364415B2

(12) United States Patent
Day

(10) Patent No.: US 7,364,415 B2
(45) Date of Patent: Apr. 29, 2008

(54) TWIN PISTON FLUID COMPRESSOR OR PUMP APPARATUS WITH AN ANNULAR BORE HOUSING

(75) Inventor: Terence Robert Day, Mt Tamborine (AU)

(73) Assignee: New Fluid Technology Pty Ltd., Mt. Tamborine, Queensland (AU)

( * ) Notice: Subject to any disclaimer, the term of this patent is extended or adjusted under 35 U.S.C. 154(b) by 0 days.

(21) Appl. No.: 10/514,231

(22) PCT Filed: May 23, 2003

(86) PCT No.: PCT/AU03/00635

§ 371 (c)(1),
(2), (4) Date: Jan. 9, 2006

(87) PCT Pub. No.: WO03/100254

PCT Pub. Date: Dec. 4, 2003

(65) Prior Publication Data

US 2006/0171836 A1 Aug. 3, 2006

(30) Foreign Application Priority Data

May 23, 2002 (AU) ..... PS2508

(51) Int. Cl.
*F03C 4/00* (2006.01)
*F04C 18/00* (2006.01)

(52) U.S. Cl. ..... 418/36; 418/195; 123/241

(58) Field of Classification Search ..... 418/33–36, 418/197, 218, 226; 123/241
See application file for complete search history.

(56) References Cited

U.S. PATENT DOCUMENTS

| | | | | | |
|---|---|---|---|---|---|
| 3,087,671 | A | | 4/1963 | Myles | |
| 3,221,717 | A | * | 12/1965 | Renshaw | 418/195 |
| 3,500,798 | A | * | 3/1970 | George | 418/36 |
| 3,739,755 | A | * | 6/1973 | Folstadt | 418/36 |
| 4,072,447 | A | | 2/1978 | Gaspar | |
| 4,844,708 | A | | 7/1989 | Lopez | |
| 4,901,694 | A | | 2/1990 | Sakita | |

FOREIGN PATENT DOCUMENTS

| | | | | | |
|---|---|---|---|---|---|
| DE | 200 476 | C | | 7/1908 | |
| DE | 3444023 | A1 | | 6/1985 | |
| FR | 1281680 | | * | 12/1961 | 418/195 |
| GB | 367 234 | A | | 2/1932 | |
| WO | WO 99/32760 | A1 | | 7/1999 | |
| WO | WO 02/42608 | A1 | | 5/2002 | |

* cited by examiner

*Primary Examiner*—Theresa Trieu
(74) *Attorney, Agent, or Firm*—Hoffman, Wasson & Gitler PC

(57) ABSTRACT

An apparatus to pump fluid comprises an annular bore (12) and at least one pair of pistons (15, 16) which travel along the bore (12). The pistons (15, 16) can be releasably locked to a rotating plate like member (14) to travel through the bore (12). One piston (15) moves with the rotating plate (14) to be the travelling piston while the other piston (16) is locked in the bore (12) to become the stationary piston. As the travelling piston hits the rear of the stationary piston, a changeover occurs where the travelling piston becomes locked to the bore (12) to become the stationary piston and the stationary piston becomes released from the bore (12) and locked to the rotating plates (14) to become the travelling piston. This arrangement is continuously repeated to provide a pump/compressor/engine and the like.

9 Claims, 12 Drawing Sheets

TWIN PISTON FLUID COMPRESSOR OR PUMP APPARATUS WITH AN ANNULAR BORE HOUSING

FIELD OF THE INVENTION

This invention is directed to an apparatus which may be in the form of a pump or compressor and which can function to compress or to accelerate a fluid such as air or a liquid. The apparatus may also comprise an engine such as a combustion engine. The apparatus includes at least two compressing members which may be in the form of pistons. Each piston can move along its stroke, but one piston remains stationary while the other piston moves to compress the fluid against the stationary piston. Thereafter, the stationary piston becomes the moving piston and the moving piston becomes the stationary piston. There is a degree of lost motion in the changeover. This procedure is repeated while the apparatus is in use. The apparatus is not limited to pumping or compressing air and may find applications with gas mixes, mixtures of gas and liquids, and the like. The apparatus can also be used to pump non compressible fluids such as liquids.

BACKGROUND ART

Pumps and compressors which use moving pistons are extremely well known in the art. Typically, the piston is connected to a crank. The piston reciprocates in a cylinder and the reciprocating action results in pumping fluid which passes into the cylinder. The pump is typically electrically powered, powered by an internal combustion motor and the like. One disadvantage with this type of pump is that pumping occurs only when piston is in the compressive stroke. When the piston is in the drawdown stroke, no pumping occurs as the drawdown stroke is required to suck additional fluid into the cylinder or housing. Therefore, half the action of the piston does not contribute to the pumping action. Another disadvantage with existing piston pumps is that the piston has a short stroke and this results in increased wear and tear of the pump. Moreover, these types of pumps generally suffer from excessive noise levels making them unsuitable in many applications.

A conventional piston in a cylinder has about a 1:1 bore to stroke ratio. For instance, if the bore has a diameter of 60 mm, the piston stroke is also approximately 60 mm. An advantage of the apparatus of the present invention is that the "piston" to "bore" ratio can be 7:1, 10:1, or even larger. Thus, the apparatus can have approximately 10 times the stroke of a conventional piston in a cylinder. This allows the apparatus to work at lower speeds, provides lower wear and reduces the noise during use of the apparatus.

It will be clearly understood that, any prior art publications referred to herein, do not constitute an admission that any of these publications form part of the common general knowledge in the art in Australia or in any other country.

OBJECT OF THE INVENTION

It is an object of the invention to provide an apparatus which can compress a fluid and which may overcome at least some of the above-mentioned disadvantages.

In one form, the invention resides in an apparatus for pumping or compressing a fluid, the apparatus comprising:

a housing which has an annular bore, at least one inlet and at least one outlet communicating with the bore, a first piston, a second piston, each said piston adapted for movement relative to the bore, drive means to drive one said piston relative to the bore, a first releasable locking means to lock and release a said piston to the drive means, and, a second releasable locking means to lock the other said piston against movement entirely along the bore.

Suitably, the drive means comprises a support member which can rotate along the bore and to which each piston can be locked and released. The support member may comprise an annular plate member, ring member and the like.

The first locking means suitably locks and unlocks the piston to the drive means. The first locking means may comprise at least one locking projection or pin, an abutment and the like.

The second locking means suitably locks and unlocks the piston against movement entirely along the bore. The second locking means may lock or hold the piston to the bore, or to some other part of the apparatus to prevent the piston from moving entirely along the bore.

The apparatus does not need to contain a reciprocating piston. Instead, one piston travels along the annular chamber or bore which is typically substantially circular. The other piston remains stationary and can be seen as forming a temporary "end wall" in the chamber. Fluid can then be compressed between the travelling piston and the stationary piston. When the travelling piston has travelled along the chamber [bore], it comes close to the rear wall of the stationary piston and the locking means can then be operated to release the stationary piston such that the stationary piston becomes the travelling piston, and the previously travelling piston becomes the stationary piston.

It should be understood that the apparatus is not limited to a pair of pistons travelling fully along the loop [bore]. For instance, it is possible for the chamber [bore] to have multiple pistons. One piston can travel partway along the loop shaped chamber until it contacts a stationary piston. The stationary piston can then be decoupled to become the travelling piston and the previously travelling piston can become a stationary piston. The new travelling piston can then move partway along the loop shaped chamber until it contacts another stationary piston. Thus, it is envisaged that a loop shaped chamber (which is typically circular) may have a plurality of pistons each defining a particular stroke length. The stroke length need not be equal for each piston and some pistons may travel along a short pathway and other pistons may travel along a larger pathway. This allows the apparatus to have multiple stroke chambers. This may make the apparatus suitable in compressing separate gases with the compressed gases passing into a common collection manifold of some sort and the different size of each stroke chamber results in the gases being compressed and mixed in different amounts.

It should also be realised that the piston may move along the chamber either by being attached to the support member and having the support member rotating or otherwise moving relative to the stationary chamber, or having a stationary support member and a moving or rotating chamber. It is also envisaged that the support member and the chamber may rotate relative to each other to move the piston along the chamber. It is however envisaged that the simplest type of apparatus will have a moving piston in a stationary chamber (bore)

The apparatus may have a substantially circular configuration when viewed in plan. One advantage of the apparatus is that each piston moves along a generally circular partway as opposed to a reciprocating pathway. This allows the stroke length to be greatly increased relative to reciprocating pistons. In turn, this can result in less wear on the apparatus, less noise during operation, a large volume flow, and it is envisaged that many of the components of the apparatus including the pistons can be manufactured from plastics material. There need be no limitation on the length of the chamber.

The apparatus contains a housing. The housing may comprise a two-part housing or a multiple part housing which are attached together. Typically, the housing comprises a two-part housing consisting of an upper and a lower part which are fastened together typically via separate fasteners such as screws, bolts and the like. Each housing part may resemble a hemisphere when viewed in side elevation. One hemisphere may contain the at least one outlet and one hemisphere may contain the at least one inlet or each hemisphere may contain both.

The housing contains an annular chamber. Suitably, the chamber is defined at least partially by the inner wall of the housing. The chamber can be seen as a bore through which the pistons travel. Alternatively, a separate loop shaped chamber may be provided in the housing. Suitably, one part of the loop shaped chamber is defined by the inner wall of the housing and another part of the loop shaped chamber is defined by the wall of a central passageway passing through the housing.

The loop shaped chamber is typically substantially circular when viewed in plan and is also typically circular in cross-section. Therefore, in one form the loop shaped chamber may be in the form of a toroid. The length of the loop shaped chamber (the stroke length) can vary to suit but it is envisaged that a length of between 20-200 cm will be suitable in respect of most applications. It should be appreciated that these values are not limiting and could, for certain applications, be exceeded, for instance in the hub of a wind turbine. The cross-section length or diameter of the chamber may vary to suit but it is envisaged that a cross-section length or a diameter of between 1-20 cm will be suitable in respect of most applications. Again, no limitation is meant by this range, and the chamber may have a diameter of 1 meter or more.

The housing is provided with at least one inlet and at least one outlet which communicate with the chamber. It is envisaged that more than one inlet may be provided and that more than one outlet may be provided. The size and shape of the or each inlet and the or each outlet may vary and the shape may be circular, oval, rectangular, polygonal, or have an irregular shape. The size of the or each inlet and the or each outlet can vary and can be from a relatively small size (to provide a nozzle effect) to a relatively large size. It is envisaged that the inlet and the outlet may be provided with a valve arrangement to regulate fluid passing into and from the chamber. It is also envisaged that some form of manifold may be provided with the inlet and the outlet and a manifold may find particular suitability if multiple inlet and outlets form part of the apparatus which may be the case if the chamber contains multiple pistons.

The apparatus contains a first piston and a second piston. Each piston is suitably shaped such that as it passes along the chamber, the piston seals, or at least partially seals against the chamber wall, or sealing means are provided to create a seal or a partial seal. Typically, the chamber will be circular in cross-section and therefore the piston will typically also be circular in cross-section. If the chamber has a different cross-section configuration, such as oval, it is envisaged that the piston will also have an oval cross-section configuration. The piston will typically have a body provided with a front face, a rear face, and an outer wall. The outer wall typically seals or is closely spaced from the wall of the chamber. The length of the body may vary to suit. For instance the piston may be substantially disk shaped which means the length of the body is quite small. The side wall or edge of the disk shaped piston is typically rounded. Alternatively, the piston may have a body length which is quite large which means that the piston will have a relatively elongate shape. It is envisaged that the outer wall of the piston will be curved in two directions to enable the piston to travel along the chamber while still maintaining a reasonably good seal between the outer wall of the piston body and the wall of the chamber.

The pistons however need not be disk shaped and may have quite irregular shapes. In one embodiment of the invention, each piston has a front wall and a rear wall. The front wall has a concave portion and the rear wall has a convex portion.

The apparatus has a drive means to drive each piston along the bore. The drive means typically comprises a support member which supports the first piston and second piston. Typically, a single support member is used to support the first piston and the second piston, but it is envisaged that the support member may also comprise more than one support member.

If the apparatus is such that the chamber is stationary and the piston travels through the chamber, it is envisaged that the support member will rotate or otherwise move to transport the piston along or through the chamber. In this embodiment, the support member may comprise a disk or a ring which rotates about its rotational axis and the first piston and/or the second piston may be attached to the support member such that rotation about the support member causes the piston to move along the chamber.

The support member is typically driven by a support drive means. The support drive means may comprise an external motor. The external motor may comprise an electric motor, a hydraulic motor, a pneumatic motor, a combustion motor and like. It is envisaged that the apparatus will contain or comprise a shaft or like member which is operatively connected to the support member and which can also be operatively connected to the support drive means such that operation of the drive means will rotate the shaft to cause rotation of the support member and therefore movement of the piston. Of course, the apparatus may also be provided with an opening or socket into which a shaft can be fitted to rotate or move the support member.

If the support member remains substantially stationary, and the chamber rotates or moves, it may be necessary to provide some form of drive means to rotate the chamber and it is envisaged that some form of drive means will be provided to rotate the housing which can therefore rotate the chamber. An example of this is where the apparatus comprises the hub of a wind turbine.

The apparatus can provided with a releasable attachment means to selectively attach the first piston and the second piston to the support member. The releasable attachment means can comprise the first releasable locking means to lock and release a said piston to the drive means.

If a single support member is provided, the releasable attachment means may releasably attach the first piston and second piston to the support member. However, a plurality of support members may be provided and there may be provided a releasable attachment means for the first piston and a releasable attachment means for the second piston. It is also envisaged that if a single support member is provided there may still be a releasable attachment means for the first piston and a releasable attachment means for the second piston.

The first releasable locking means may comprise at least one projection which may be on the piston, the support member and/or the chamber and at least one recess which may be on the piston, the support member and/or the chamber. Suitably, the at least one projection forms part of or is carried by the piston and the at least one recess is provided on or in the support member and/or the chamber. A plurality of projections may be provided.

The projection may comprise an elongate slide which may be formed separately from the piston and which may extend through a slot in the piston. The slide may comprise a pin, finger, a rod, a strip and like. Typically, the slide extends from the outer wall of the piston and can move between an extended position where the slide extends from the outer wall of the piston, to a retracted position where the slide is flush with the outer wall of the piston or is retracted into the piston body. When the slide is in the extended position, it can catch or engage in a recess on the chamber and/or the support member which will hold the piston against movement through the chamber. When the slide is in the retracted position, the piston is free to move through the chamber typically by being attached to the support member.

The slide may have an outer edge that comprises a rotating member such as a ball (for instance a ball bearing). The wall of the chamber may contain a small annular groove along which the ball travels to reduce wear.

It is envisaged that the first releasable locking means will be provided to selectively attach the first piston and second piston to the support member and that the second releasable locking means will be provided to selectively attach the first piston and second piston relative to the chamber. Thus, when the piston is attached to the support member, rotation of the support member will cause the piston to move through the chamber. When the piston is attached relative to the chamber, movement of the support member will not cause the piston to move. It is preferred that the above means are somewhat combined as will be described in greater detail below.

No limitation is meant to be construed on the invention by the above description of the releasable attachment means. For instance, the releasable attachment means may comprise a magnetic means to magnetically hold the piston in position and to release the piston. Other means to hold and release each piston are envisaged and may comprise part of the invention.

In the embodiments, the apparatus is described utilising a single pair of pistons and ports, or three pairs of pistons and ports. However, no limitation is meant thereby and the apparatus can have other numbers of piston pairs and ports.

Moreover, no limitation is meant to be construed on the invention by the description of the invention as a compressor or a pump. For instance, it is envisaged that the invention can be utilised as an engine.

BRIEF DESCRIPTION OF THE DRAWINGS

Embodiments of the invention will be described with reference to the following figures in which.

BEST MODE

Figure 1:
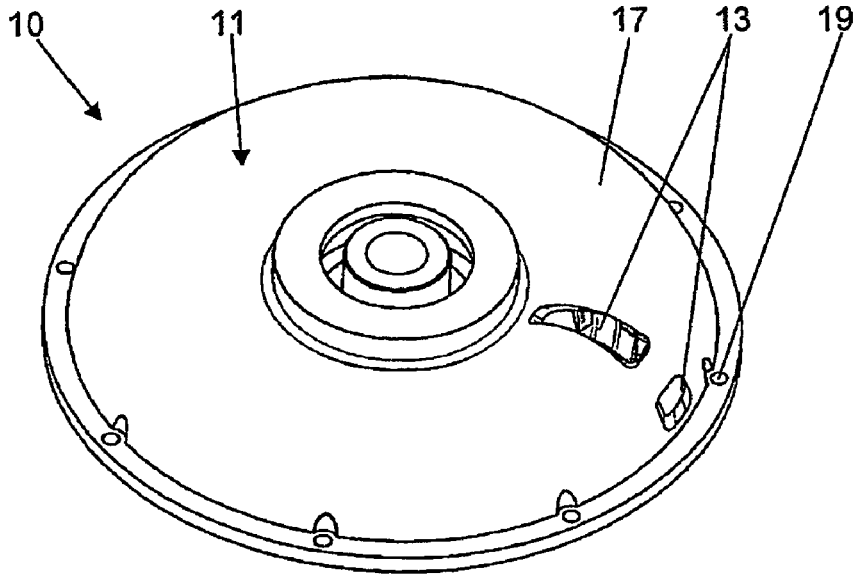
FIG. 1. Illustrates the upper housing of the apparatus.
Figure 2:
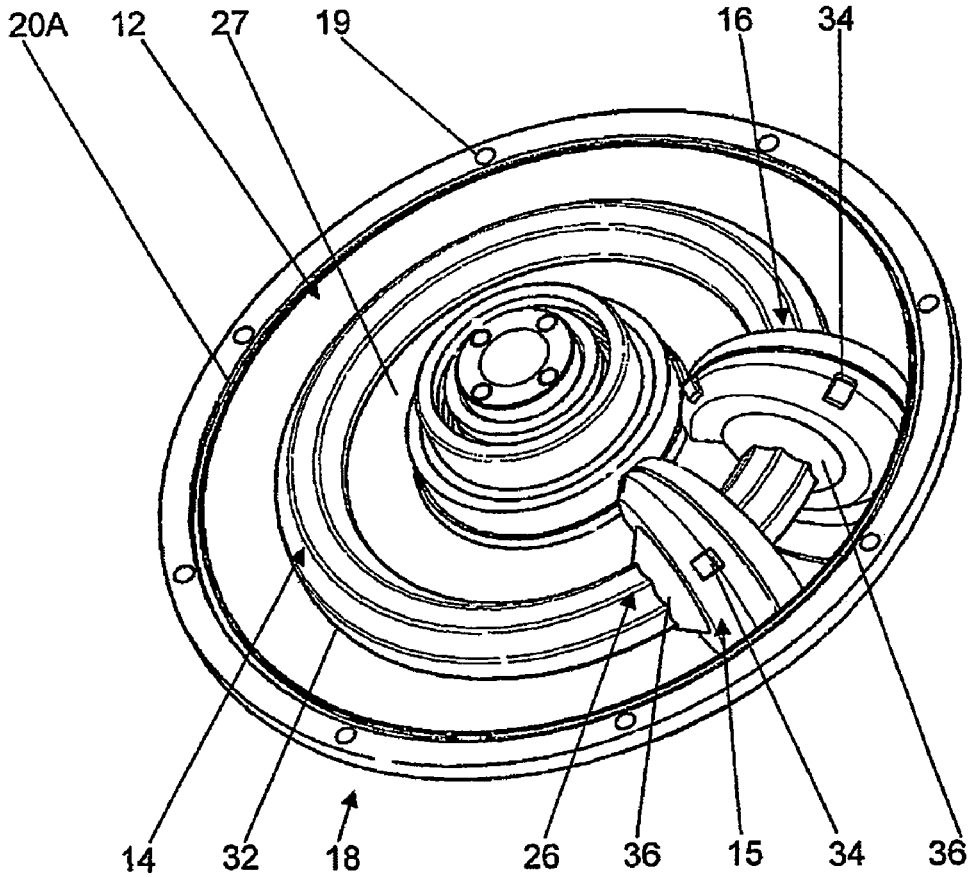
FIG. 2. Illustrates the inside of the apparatus and particularly illustrates a first piston and a second piston.

Referring to the figures and initially to FIGS. 1-4, there is illustrated an apparatus 10 which can function as a pump or compressor to pump gases, liquids, flowable powders, mixtures and the like. Apparatus 10 comprises a housing 11, which defines a circular internal bore/chamber 12 (best illustrated in FIG. 2-3), the housing being provided with at least one inlet/outlet 13, a first piston 15, a second piston 16, a drive means in the form of a support member which in the particular embodiment is in the form of a ring 14 and a first and second releasable locking means which will be described in greater detail below.

Housing 11 can be made of plastics material and comprises two parts being an upper part 17 and a lower part 18. The two parts are attached together by fasteners passing through holes 19. A seal 20A is provided between the two parts to provide a fluid tight housing. When the two parts are attached together, there is provided an internal ring-shaped recess which forms the loop shaped chamber 12 [which can also be seen as a bore]. The chamber is defined by the inner wall 21 of the upper housing part and inner wall 22 of the lower housing part (see FIG. 9). The chamber 12 is substantially circular when view and plan and is also substantially circular in cross-section. The size (or volume) of chamber 12 will depend on the size of the housing. Typically, chamber 12 will have a diameter of between 10-200 mm and will have a length of between 40-200 centimetres. This can of course vary to suit. The housing may have a wall thickness of between 3-20 mm. These parts can be made identical to reduce manufacturing costs.

In this particular embodiment, the upper housing part 17 is provided with two outlets 13. The configuration and the number of the outlets or the inlets can vary.

Pistons 15, 16 are generally identical and can be made of plastic material, metal and the like. FIGS. 5-8 illustrate the pistons in greater detail. Each piston is made of generally solid material and comprises an outer peripheral wall 24, a front face 25 and a rear face 26. The piston is sized to slide along the chamber and to provide a compressive effect to the fluid in the chamber which means that piston must be in sealing engagement with the chamber wall or closely spaced from the chamber wall to minimise fluid passing between the outer wall of the piston and the wall of the chamber. Therefore, the outer wall of the piston is generally circular. Because that piston has an appreciable length, the outer wall must also be curved along the direction of travel to accommodate the curvature of the chamber.

In this particular embodiment, each piston is attached to a support member 14. Support member 14 is better illustrated in FIGS. 4, 9 and 10 and comprises a circular disk 27 having a thickened outer edge 32 which has a plurality of flat surfaces to approximate an octagon (see FIG. 10). Support member 14 is designed to rotate about its rotational axis in the housing and in doing so to rotate the travelling piston by attaching the travelling piston to the edge of the support member 14. This will be described in greater detail below.

Support member 14 is mounted for rotation in the housing as follows: the disk like support member is provided with a central collar 28 which extends above and below the disk. A bearing assembly 29 is attached to collar 28 to allow support member 14 to rotate relative to housing 11. An external drive member [not illustrated] is attached to collar 28 and rotation of the drive member causes rotation of support member 14 in the otherwise stationary housing 11.

As best illustrated in FIGS. 5-8, each piston is provided with a key slot 31 which allows the piston to be attached over the outer edge 32 of support member 14. Slot 31 is marginally larger than the thickness of outer edge 32 which means that the piston does not tightly clamp to the outer edge 32 of support member 27. Instead, the piston is attached by the releasable locking means which will be described in greater detail below. The releasable locking means allows the piston to be selectively coupled to the rotating support member 14 to move with the support member, or to be decoupled from the support member 14 such that rotation of the support member does not result in movement of the piston.

Figure 9:
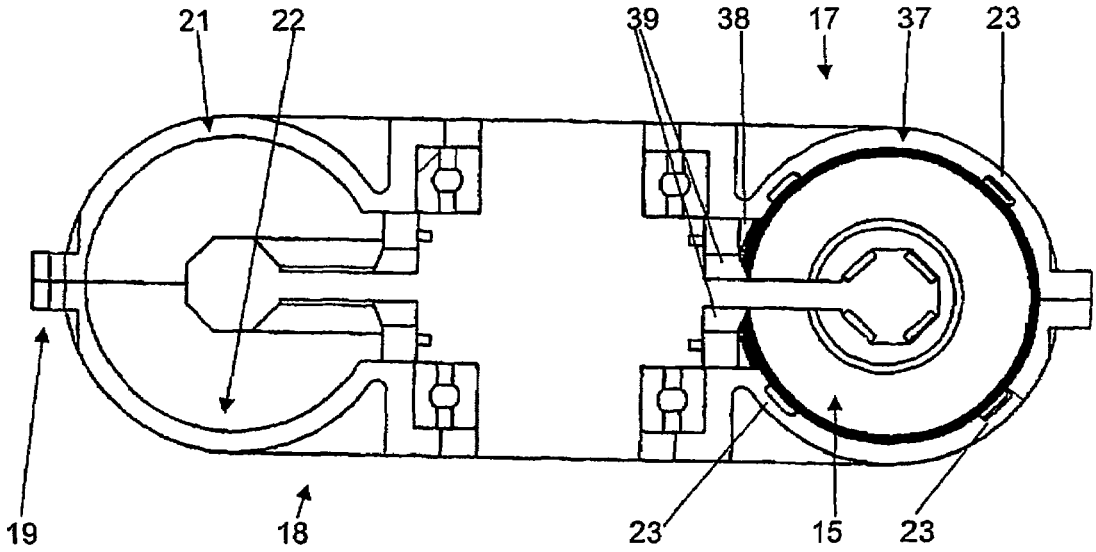
FIG. 9. Illustrates a cross-section of the apparatus.
Figure 10:
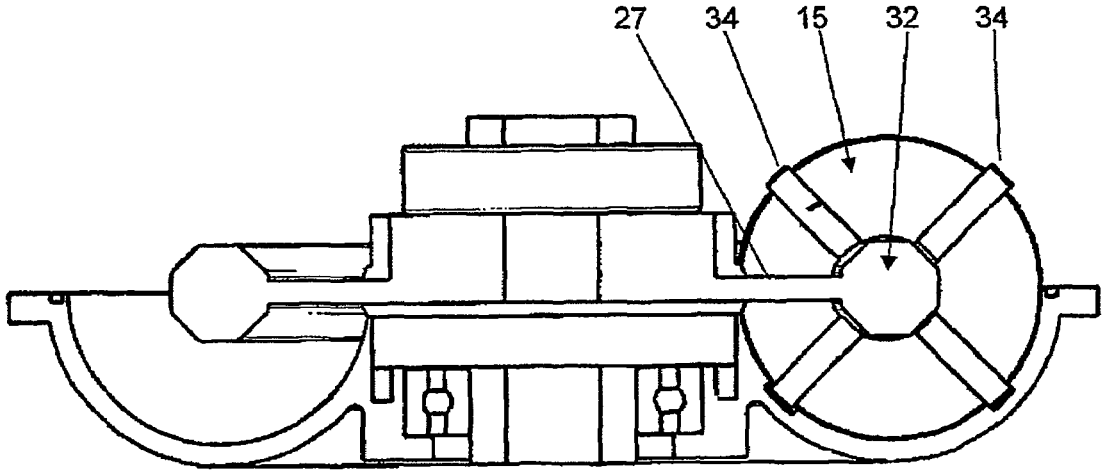
FIG. 10. Illustrates a partial cross-section of the apparatus.

In a particular embodiment, the releasable attachment means comprises a combination of projections (in the form of sliders 34) on each piston, a number of recesses 20 in the thickened outer edge 32 of support member 14 (best illustrated in FIG. 4), and recesses 23 in the wall of chamber 12 (see FIGS. 9-10). Each piston 15, 16 is provided with a plurality of such sliders 34 (in the embodiment 4 sliders are present) which extend through openings 35 in the outer wall 24 of the piston. Each slider is elongate and rigid and is substantially rectangular when viewed in plan. Each slider passes through a corresponding opening 35 in the outer wall of the respective piston. Importantly, the opening 35 passes entirely through the piston from the outer wall 24 to the inside of the keyhole slot 31. Each slider has a length which is slightly longer than the length of the recess. This means that the slider must either project slightly from the outer wall 24 of the piston, or if the slider is pushed to be flush with the outer wall 24 of the piston, the other end of the slider projects into the keyhole slot 31. For instance, in FIGS. 5-6, sliders 34 are in the retracted position where the outer edge of the sliders does not project from outer wall 24 and the inner edge of each slider projects into the keyhole slot 31. In this arrangement, the piston is locked to the support member 14 by the sliders engaging in the recesses 20 (see FIG. 4) on the support member 14. Alternatively, in FIGS. 7-8 sliders 34 have the outer edges extending from outer wall 24 of the piston and the inner edges do not project into the keyhole slot. In this arrangement, the piston is decoupled from the support member and is coupled to the chamber wall 12 by engaging in recesses in the chamber wall. Thus, each piston can be either coupled to the support member 14 for rotation with the support member to make the piston a "traveling" piston or decoupled from the support member 14 and coupled to the chamber wall 12 to make the piston a "stationary" piston.

Each slider is free to slide within the respective recess 35 and it is not necessary to provide any springs to move the sliders.

The pistons are coupled/released from the support member 14 and the chamber wall when the travelling piston abuts against the stationary piston which will be described immediately below and with reference to FIGS. 11-15.

Figure 11:
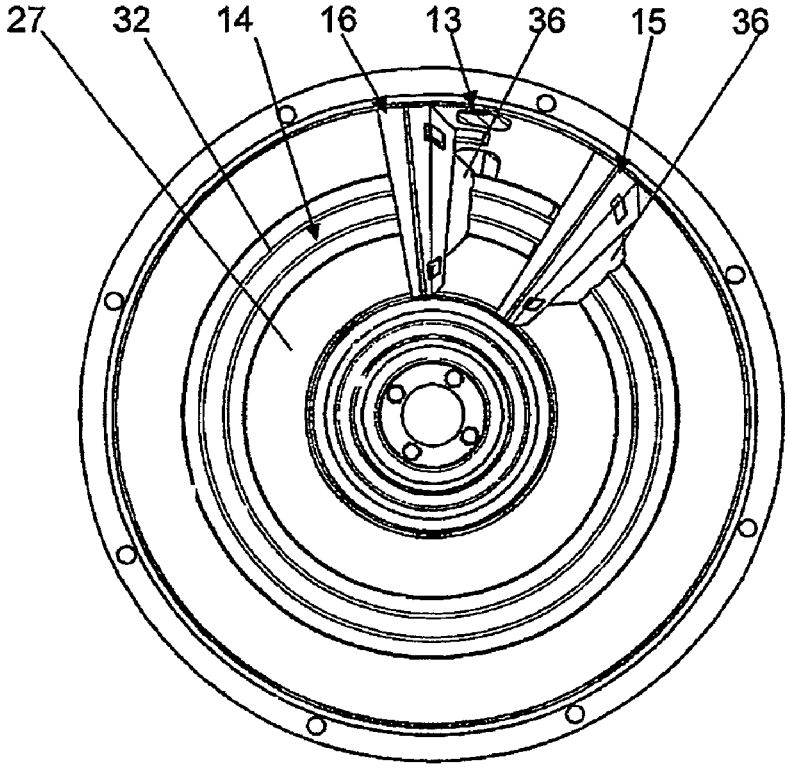
FIGS. 11-15 illustrate sequentially the operation of the apparatus and the locking/unlocking of each piston.

Referring to these figures, and initially to FIG. 11, there is illustrated a stationary piston 16 and a travelling piston 15. Travelling piston 15 is coupled to rotating support member 14 by having its sliders engaged in the recesses 20 (see FIG. 4) on support member 14. This is the "first releasable locking means" The rotating support member in FIG. 11 rotates in an anticlockwise direction. The sliders will have the position illustrated in FIGS. 5-6 where the sliders project into keyhole slot 31 and therefore into recesses 20 on support member 14. Conversely, stationary piston 16 has its sliders 34 in the position illustrated in FIGS. 7-8 where the sliders project from the outside wall 24 of piston 16 and engage into recesses 23 (see FIGS. 9-10) in the chamber wall. This is the "second releasable locking means".

Figure 12:
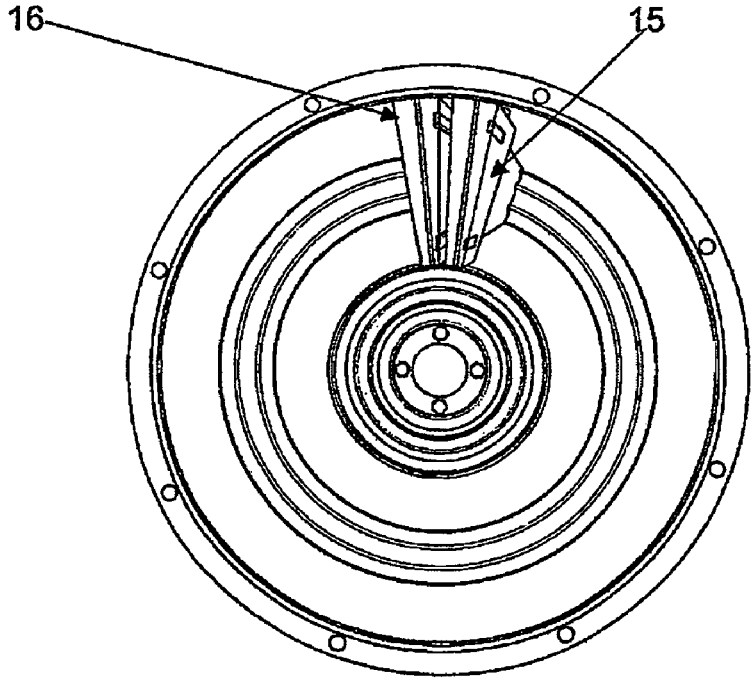
Figure 13:
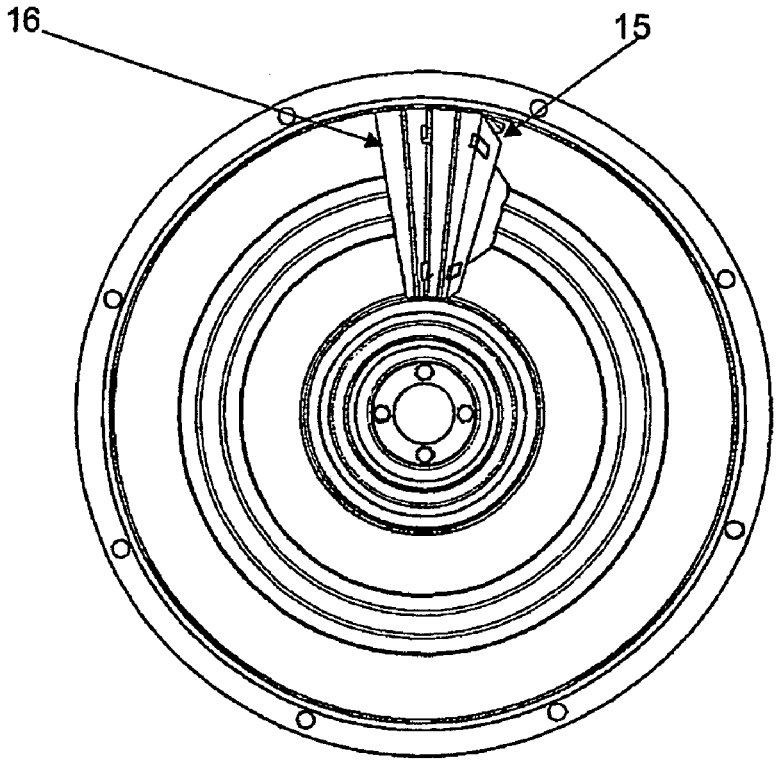
Figure 14:
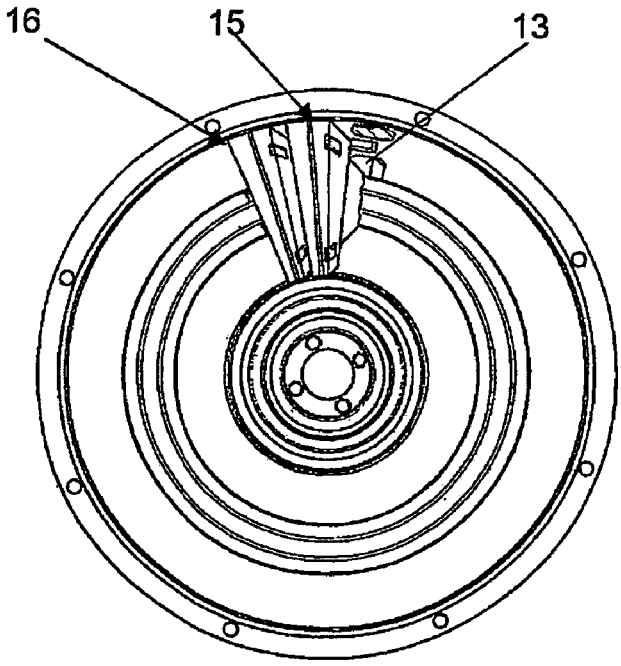
Figure 15:
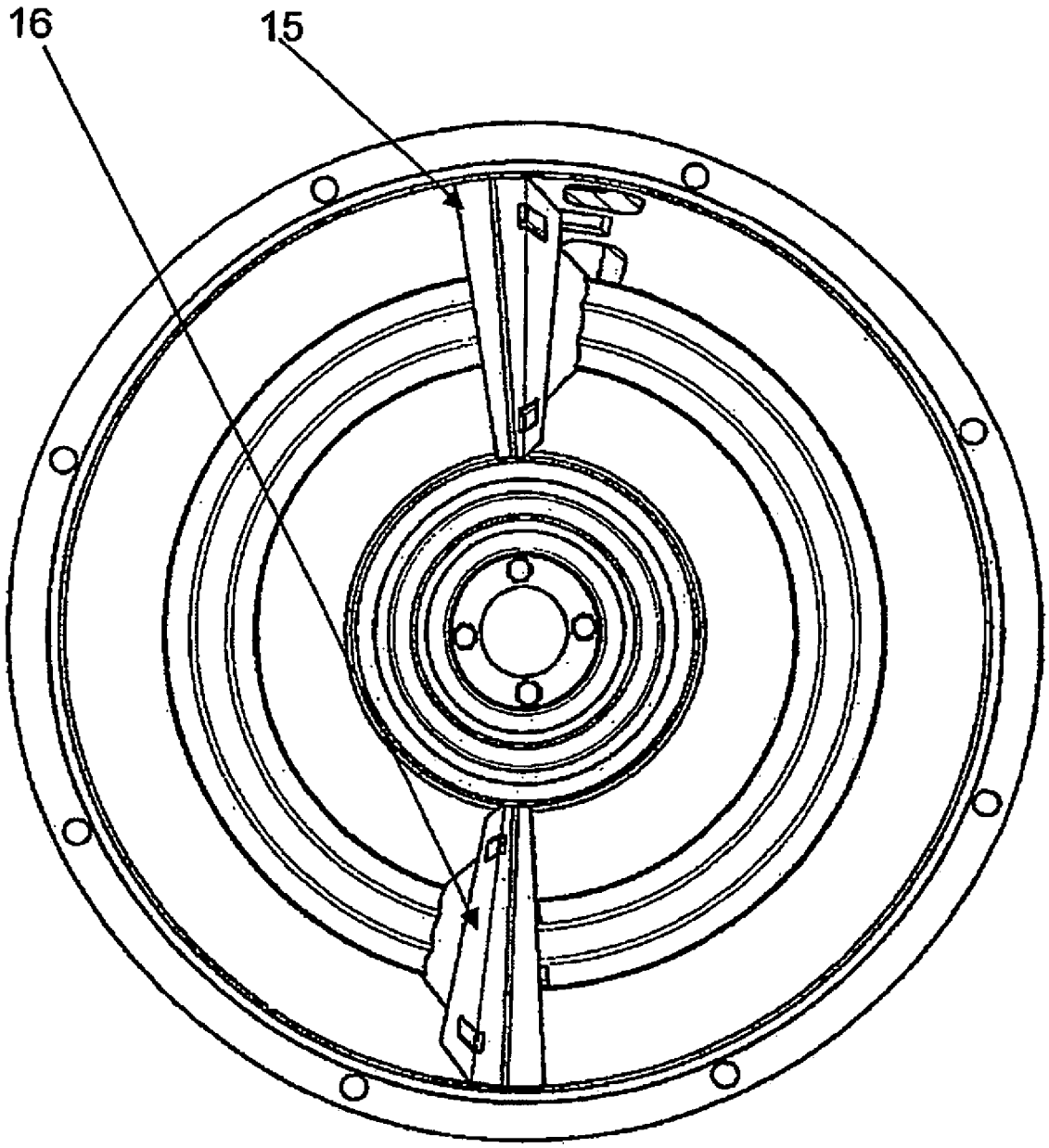

Referring to FIG. 12, support member 14 has rotated in the anticlockwise direction such that travelling piston 15 abuts against the rear face 26 of stationary piston 16. As described previously, the rear face 26 of each piston is convex and has a ramped portion 36 (best illustrated in FIG. 2 and FIG. 11). The front face 25 of each piston is concave this being best illustrated in FIGS. 3, 5 and 7. The inner (lower) edge of each slider projects into the concave portion (see FIGS. 5-7, and one slider 34 being illustrated in FIG. 3). Therefore, as the travelling piston hits the rear face of the stationary piston, the ramped portion 36 of the stationary piston will engage with the inner edge of each slider 34 and will push the sliders upwardly to project from the outer wall 24 of travelling piston 15 (to adopt the position illustrated in FIG. 7). Consequently, this causes the travelling piston to now release from the support member 14 and to engage into recesses 23 in the wall of chamber 12. (The recesses 23 are carefully positioned to become available for use in this part of the chamber) Thus, the travelling piston now becomes the stationary piston.

Figure 3:
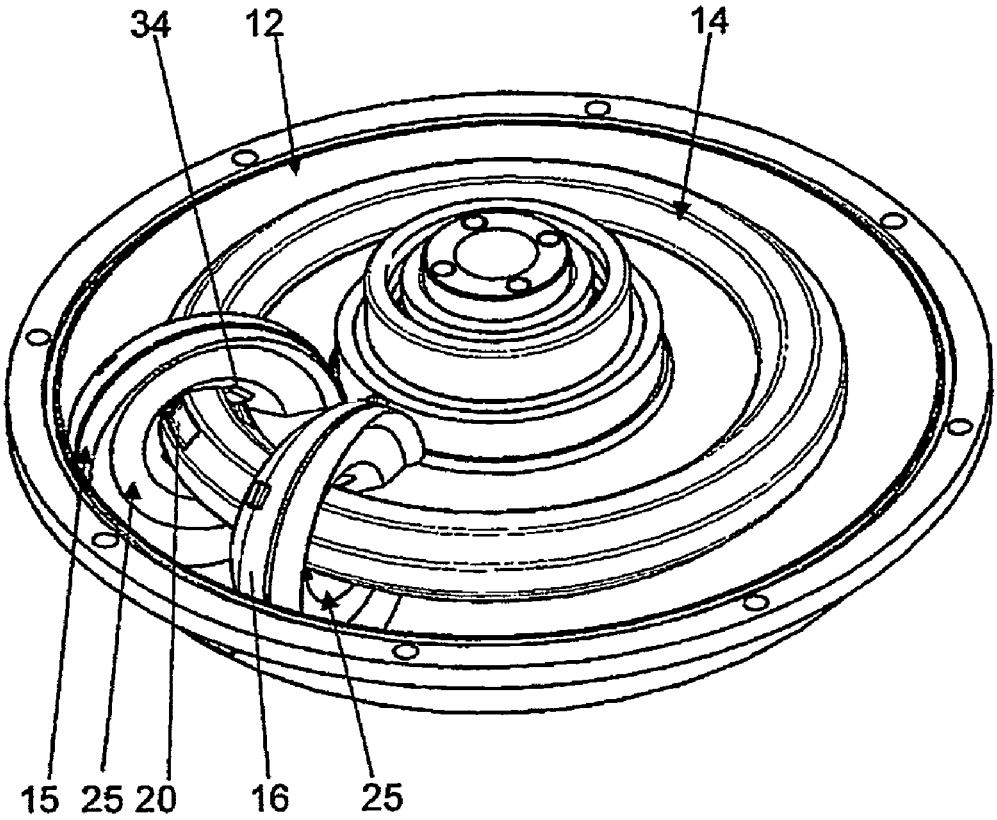
FIG. 3. Illustrates the apparatus of FIG. 2 and particularly illustrates the first piston and the second piston from the other side.
Figure 4:
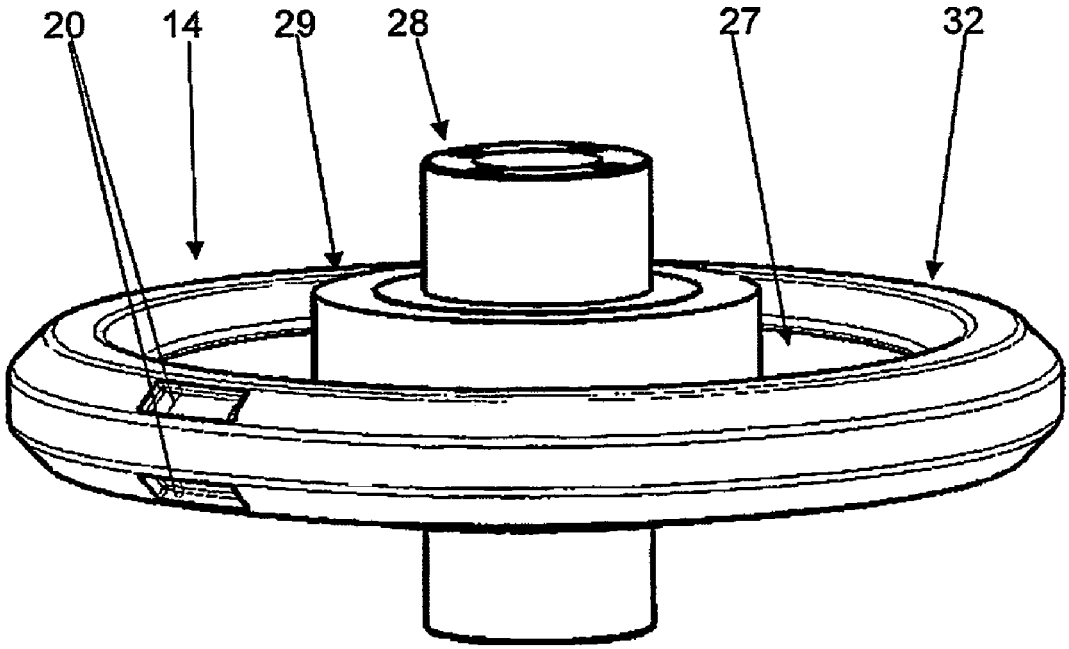
FIG. 4. Particularly illustrates the drive means and shows elongate recesses in the drive means which form part of the locking/release mechanism of each piston.
Figure 5:
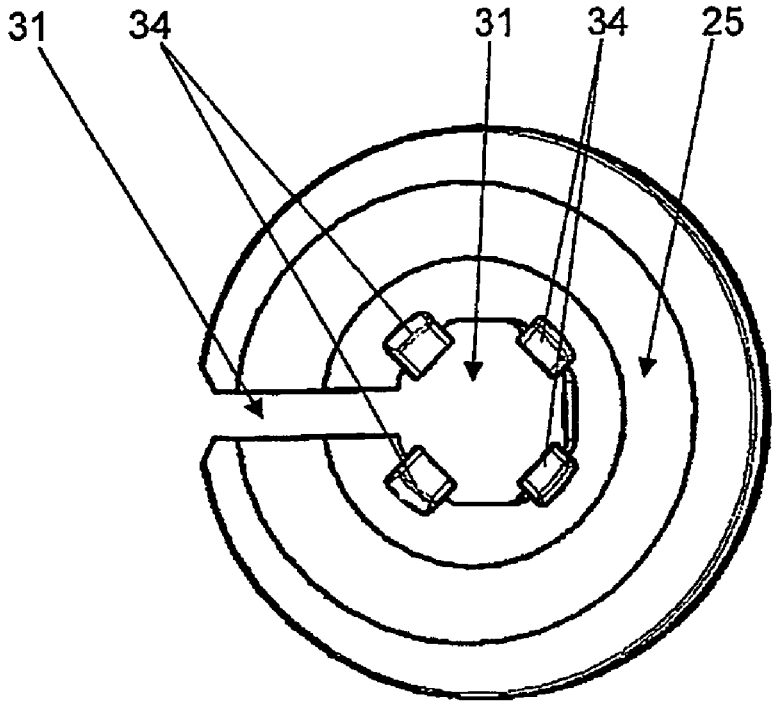
FIG. 5. Illustrates a piston from one side and particularly illustrates 4 locking slides or pins which are in the retracted position to lock the piston to the drive means.
Figure 6:
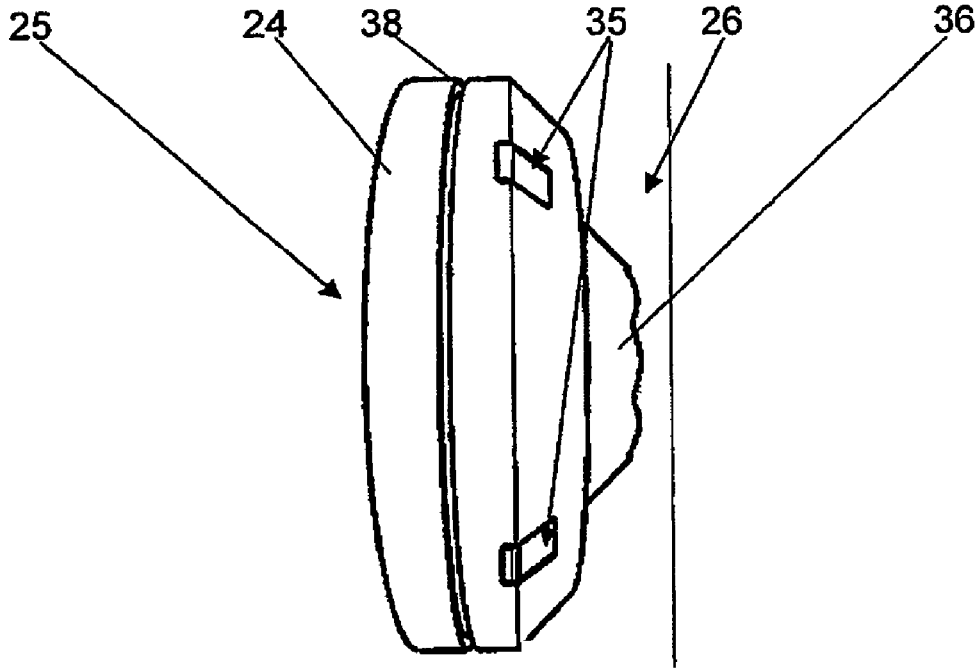
FIG. 6. Illustrates in side view the piston of FIG. 5 with the locking slides in the retracted position to lock the piston to the drive means.
Figure 7:
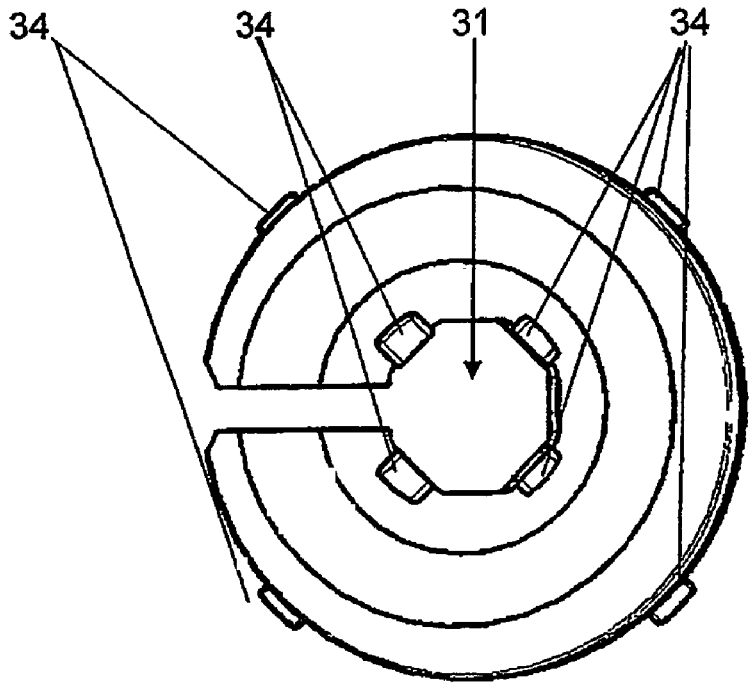
FIG. 7. Illustrates the piston of FIG. 5 and particularly illustrates the locking slides or pins in the extended position to release the piston from the drive means and to lock the piston against the walls of the bore.
Figure 8:
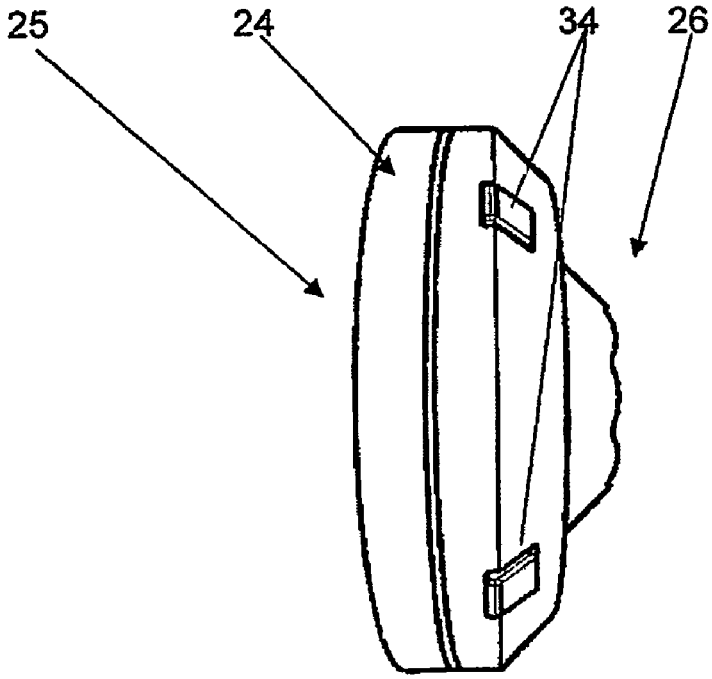
FIG. 8. Illustrates the piston of FIG. 7 in side view showing the locking slides in the extended position.

Best illustrated in FIG. 3, piston 15 is attached to support member 14 via recesses 20. As the recesses 20 are elongate, 2 the front portion of the recess leads piston 15, or put differently, the front portion of the recess is in front of travelling piston 15 this being best illustrated in FIG. 3. Consequently, as piston 15 hits the rear face of piston 16, recesses 20 are positioned underneath sliders 34 of piston 16. This allows sliders 34 of piston 16 to drop from the extended position (see FIG. 7) to the retracted position (see FIG. 5). Thus, the sliders 34 of piston 16 unlock from engagement with recesses 23 in the chamber wall and drop into engagement with recesses 20 which has the effect of locking piston 16 to support member 14 which converts piston 16 from the "stationary" piston to the "travelling" piston.

This process is repeated as the "travelling" piston is rotated by support member 14 and contacts the rear of "stationary" piston to release the "stationary" piston and to lock the "travelling" piston.

The chamber is provided with inlets/outlet ports 13 which are in the area where the pistons lock/unlock. Referring to FIG. 11, travelling piston 15 has conducted an almost full stroke through the annular chamber and, as it approaches the rear face of stationary piston 16, the gas/liquid is being compressed and passes through an outlet port. During the changeover period, the ports can be sealed by the pistons. As the original stationary piston decouples from the chamber wall and couples to the support member 14 and therefore becomes the travelling piston it will begin rotating through the chamber and, behind the piston, an inlet port will open to allow new liquid/fluid to be drawn into the chamber. Simultaneously, the liquid/fluid in front of travelling piston will now be compressed as the travelling piston completes its rotation through the chamber. Thus, while the travelling piston is compressing fluid in front of it, it is also drawing in the next charge which is unlike conventional pistons.

Each piston 15, 16 is provided with a peripheral sealing ring 37 (see FIG. 9) which fits inside a peripheral recess 38 (see FIG. 6) in each piston. The sealing ring is split. Each free end of the sealing ring 37 is provided with a ramped face 38. A second pair of sealing rings 39 is provided above and below the disk portion 27 on support member 14 to provide sealing against fluid leakage into the interior of the apparatus. These sealing rings are also provided with a ramped face which cooperates with the ramped face 38 on each free end of the sealing ring 37. Sealing ring 37 provides a slight spring bias against sealing ring 39 to bias sealing ring 39 against disk portion 27 to improve the quality of the seal in this area.

Figure 16:
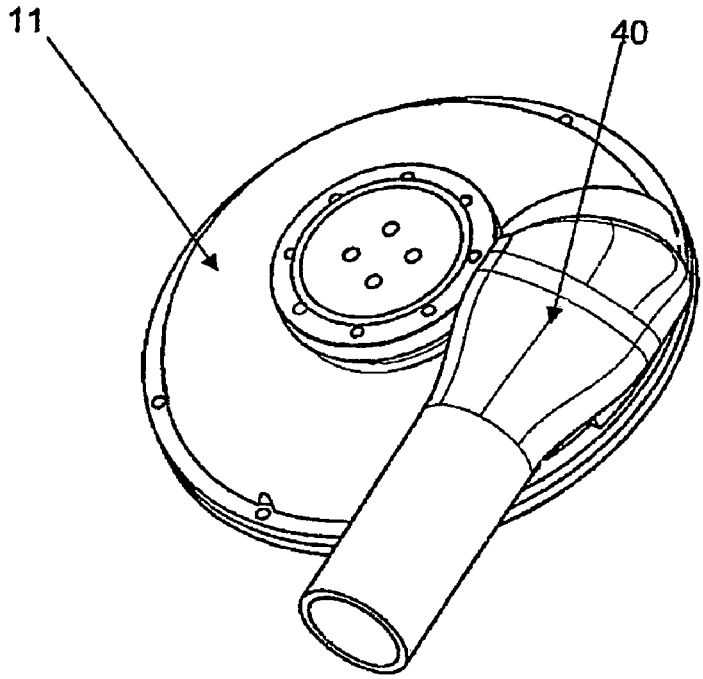
FIG. 16. Illustrates an inlet or exhaust port on the apparatus.
Figure 17:
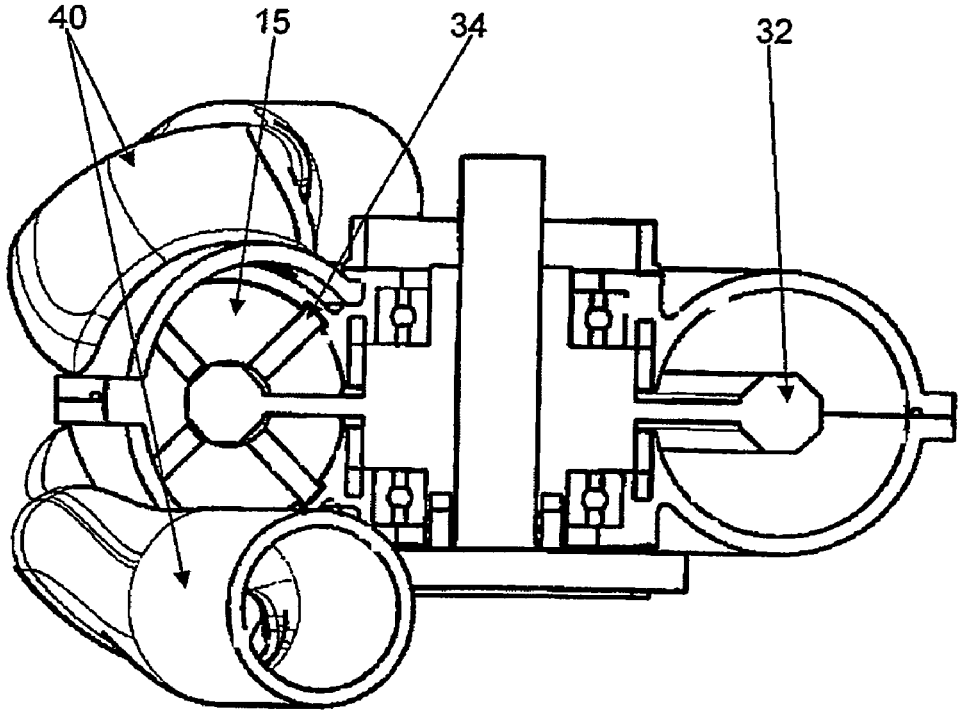
FIG. 17. Illustrates in cross-section an apparatus having a manifold on the inlet port and the outlet port.

FIG. 16 and 17 Illustrate the attachment of inlet/outlet pipes 40 to the openings 13 in housing 11 to facilitate drawing in and removal of fluid into the chamber.

Figure 22:
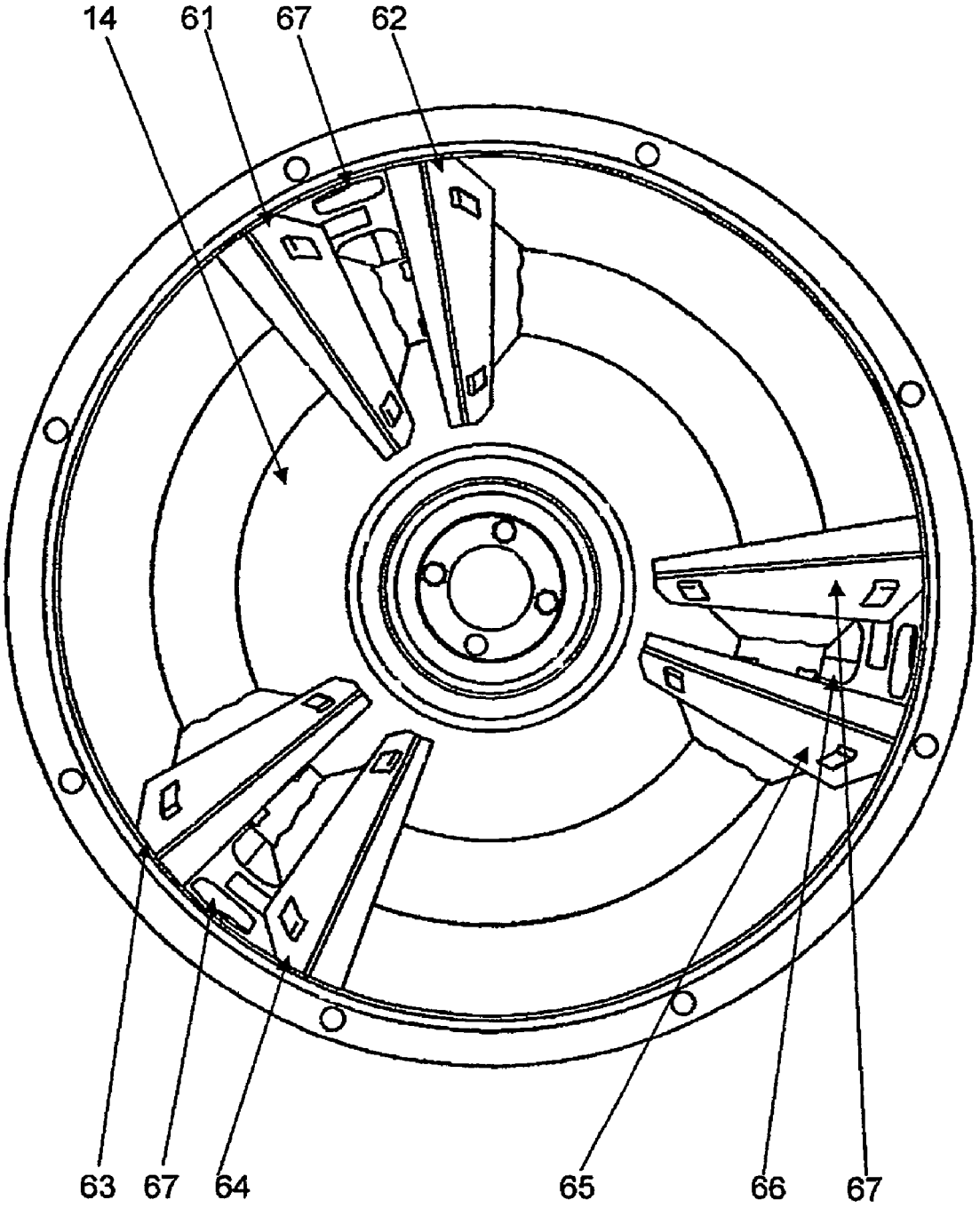
FIG. 22. Illustrates an apparatus generally as illustrated in FIG. 2, but with three pairs of pistons to define three separate strokes.

FIG. 22 illustrates a variation to the above apparatus the variation being to include three pairs of pistons as opposed to a single pair of pistons. Thus, the apparatus has a support member 14 which is generally the same as that described above. Three pairs of pistons are provided being piston pair 61, 62, piston pair 63, 64, and piston pair 65, 66. Each piston is as described above, The pistons are coupled and decoupled to the support member 14 and the walls of the chamber in the manner described above. Ports 67 are provided for each piston pair to provide intake and exhaust of the fluid. In the particular embodiment, the piston pairs are shown as being equally spaced apart which means that the stroke length of each piston is identical. However it is envisaged that the piston pairs may be spaced apart in a different manner to provide variable stroke lengths. Briefly, as a particular piston becomes the travelling piston, it will abut against the rear of the piston in front of it and the coupling/decoupling (changeover) will occur.

Figure 18:
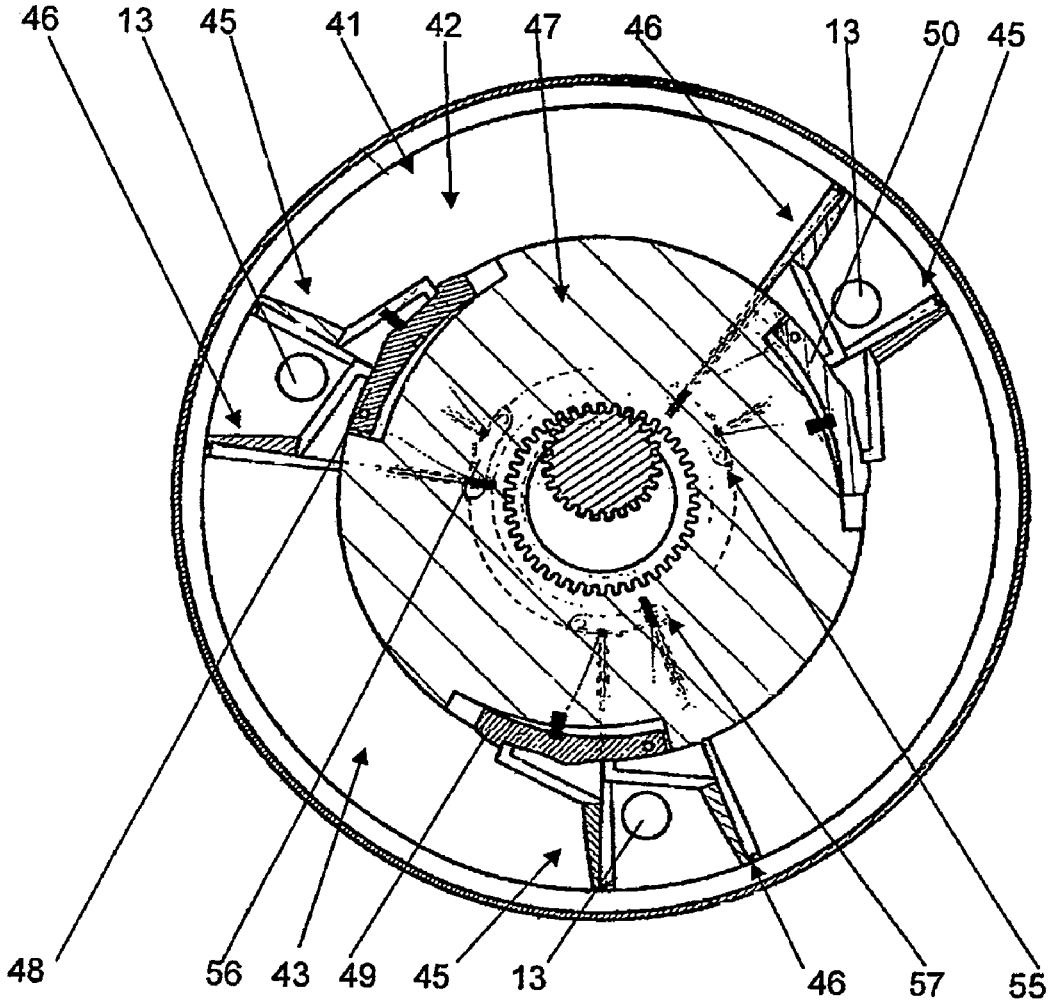
FIG. 18. Illustrates a second embodiment of the invention which uses 2 rocker arms to couple/decouple each piston from the drive means.
Figure 19:
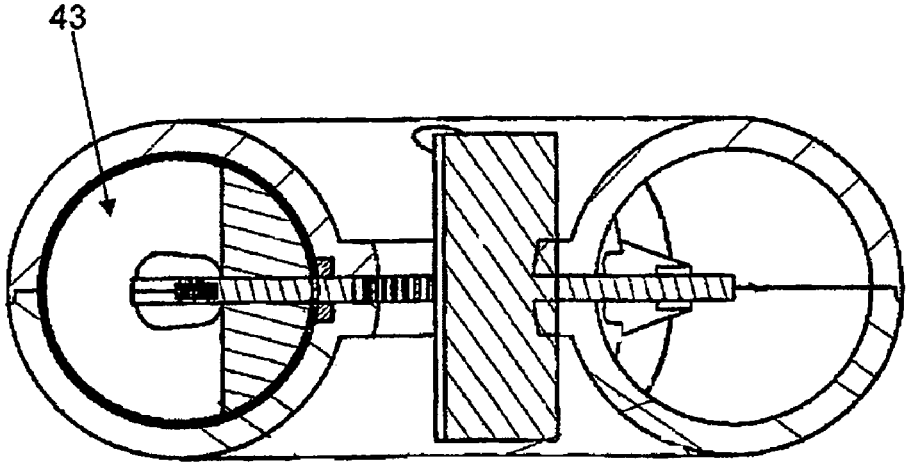
FIG. 19. Illustrates a cross-section of the apparatus of FIG. 18.

FIGS. 18-21 illustrate a second embodiment of the invention. In this embodiment, there is again provided an annular chamber 41. This embodiment of the invention works in a manner similar to that described above in that there is provided a travelling piston and a stationary piston which lock/unlock. In the particular embodiment of FIG. 18, there is provided three pairs of pistons. This means that instead of a travelling piston travelling entirely through annular chamber 41, a particular travelling piston will only travel until it strikes the rear of the next stationary piston at which stage the travelling piston becomes the stationary piston and the stationary piston becomes the travelling piston. In the embodiment of FIG. 18, it can be seen that the annular chamber is divided into three chamber sections 42-44 each of which approximates one-third of the original annular chamber 41. In the particular embodiment illustrated in FIG. 18, the pairs of pistons have been placed equally spaced apart but there is no need to do so and it is envisaged that the pistons can be placed to provide varying stroke lengths in each chamber sections 42-44.

The pistons 45, 46 are again locked and unlocked to a rotating support member 47. However, this is not achieved by sliders, and in this particular embodiment, the locking/unlocking is achieved by rocker arms and in particular two rocker arms are provided to lock/unlock the pistons. This is achieved as follows.

Figure 20:
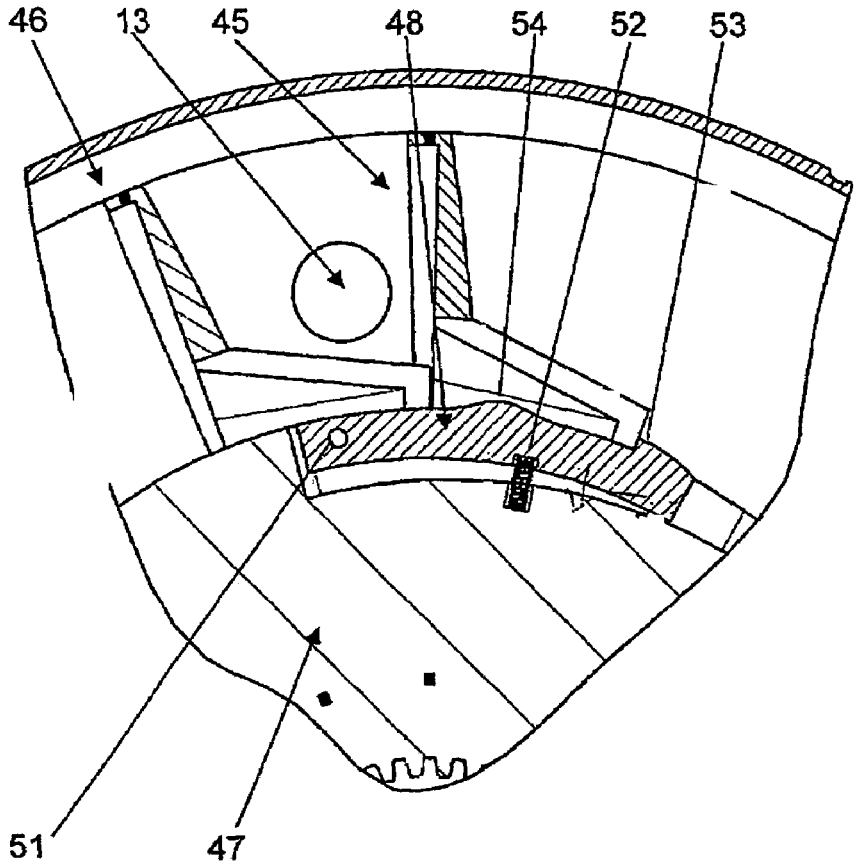
FIG. 20. Illustrates in greater detail the first rocker arm which functions to release the traveling piston from engagement with the drive means.
Figure 21:
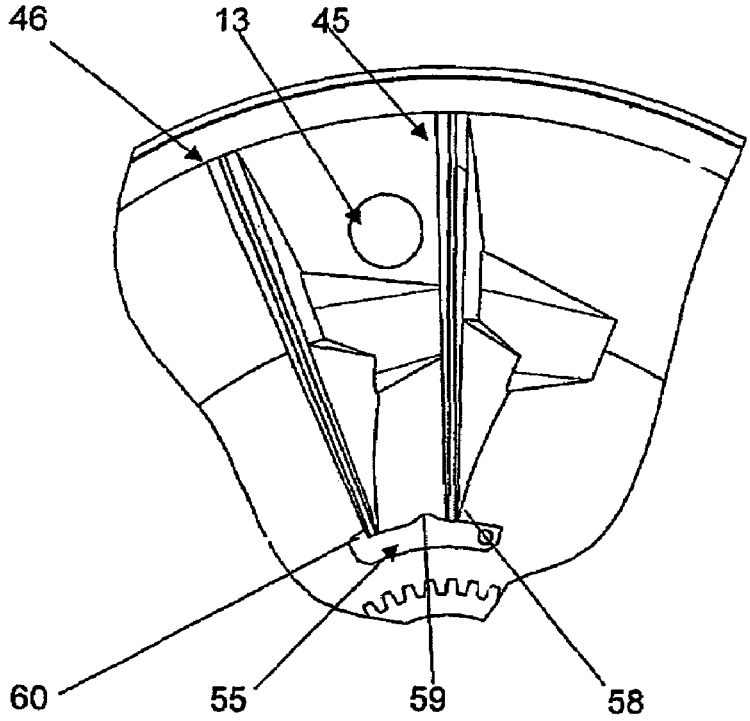
FIG. 21. Illustrates in greater detail the second rocker arm which functions to lock the stationary piston to the drive means to convert the stationary piston to the traveling piston.

The rotating support member 47 is provided with three rocker arms 48-50 which are attached to support member 47 and therefore rotate with support member 47. These rocker arms are illustrated in greater detail in FIG. 20. It can be seen from FIG. 20. that the rocker arm (in this case rocker arm 48) is pivoted at one end to pivot 51 and is biased by spring 52. Rocker arm 48 contains an abutment or shoulder 53, and a hump 54 intermediate the length of the rocker arm. The rocker arm can move between an extended position where shoulder 53 projects lightly into chamber 41 and a depressed position where shoulder 53 does not project slightly into chamber 41. Referring to FIG. 20, there is illustrated a travelling piston 45 and a stationary piston 46 and support 47 which is rotating in an anticlockwise direction. Travelling piston 45 is locked to support member 47 by having a part of travelling piston 45 abutting against shoulder 53. Thus, as support member 47 rotates in an anticlockwise direction, travelling piston 45 also rotates through chamber 12. As travelling piston 45 moves towards the rear of stationary piston 46 (this being illustrated in FIG. 20) the rocker arm will begin to move under stationary piston 46. At some stage, the stationary piston will travel over hump 54. When this occurs, the stationary piston will depress rocker arm 48 against the bias of spring 52, and in doing so, travelling piston 45 becomes released from abutment against shoulder 53. Thus, travelling piston 45 has become decoupled from support member 47.

Illustrated in FIG. 18, a second set of three rocker arms are positioned towards the centre of the apparatus, and these rocker arms are given reference numerals 55-57. These rocker arms do not travel with support member 47. These rocker arms are illustrated in greater detail in FIG. 21. As travelling piston 45 moves towards stationary piston 46, the inner edge 58 of travelling piston 45 rides over a hump 59 on rocker arm 55. As this occurs, rocker arm 55 is depressed which releases piston 46 against engagement with a shoulder 60 on rocker arm 55. This happens simultaneous with operation of the rocker arm 48 which is attached to support member 47. Thus, as travelling piston 45 decouples from engagement with rocker arm 48 it also rides over hump 59 on rocker arm 55 to release stationary piston 46. Further movement will cause the inner edge 58 of travelling piston 45 to engage with shoulder 60 which now locks the travelling piston 45 in place and therefore converts the travelling piston 45 to a stationary piston.

The original stationary piston 46 has passed over hump 54 on rocker arm 48 and has engaged with shoulder 53 such that the original stationary piston 46 now travels with the rotating support member 47 to become the travelling piston.

If more than one pair of pistons and ports is employed, they may be spaced at different distances apart to minimise potential stagnation during piston changeover. For example, if three piston pairs are employed, these may be placed at 0°, 110° and 240° which means that there will always be two sections between piston pairs that are pumping while only one of the pairs is experiencing a changeover. The ports may be wider than the pistons or narrower than the pistons. If the apparatus is used as a water pump, there may be an opening between the pistons when the pistons are close, the opening communicating with the chamber containing a gas which can act as a spring. Each slider may have a flat on each end to reduce where and tear.

It should be appreciated that various other changes and modifications can be made to the embodiment described without departing from the spirit and scope of the invention

The invention claimed is:

1. An apparatus for pumping or compressing a fluid, the apparatus comprising:

a housing which has an annular bore, at least one inlet and at least one outlet communicating with the bore, a first piston, a second piston, each said piston adapted for movement relative to the bore, drive means to drive one said piston relative to the bore, a first releasable locking means to temporarily lock and release a said piston to the drive means, and a second releasable locking means to temporarily lock the other said piston against movement along the bore, wherein the first and second pistons move according to a repeating cycle in which the first piston, when locked to the drive means, moves in a unidirectional at least partial loop around the bore until movement of said first piston unlocks the second piston which is until then locked against movement relative to the bore, and the first piston replaces the second piston by becoming the piston locked against movement relative to the bore and the second piston becomes the piston locked to the drive means.

2. The apparatus as claimed in claim 1 wherein the drive means comprises a support member.

3. The apparatus as claimed in claim 2 wherein the support member rotates about an axis and comprises an outer thickened edge, the first piston and the second piston being releasably locked relative to the thickened edge.

4. The apparatus as claimed in claim 1, wherein the first releasable locking means and the second releasable locking means comprise at least one slider.

5. The apparatus as claimed in claim 4, wherein a plurality of sliders are provided, the sliders being attached to each said piston.

6. The apparatus as claimed in claim 4, wherein each said piston comprises a front face, a rear face and an outer edge, the front face having a concave portion, the rear face having a convex portion, the sliders being movable between a first position where the sliders lock the said piston against the drive means, and a second position where the sliders lock the said piston against the bore, the sliders being movable between the first position and the second position upon contact of the front face of one said piston with the rear face of the other said piston.

7. The apparatus as claimed in claim 1 wherein the first releasable locking means and the second releasable locking means comprise rocker arms.

8. The apparatus as claimed in claim 7, wherein two rocker arms are present, one comprising the first releasable locking means and the other comprising the second releasable locking means, one said rocker arm being attached to the drive means, the other said rocker arm not being attached to the drive means.

9. The apparatus as claimed in claim 1 comprising a plurality of pairs of said first piston and said second piston.

* * * * *